US008794114B2

(12) United States Patent
Chiapuzzi

(10) Patent No.: US 8,794,114 B2
(45) Date of Patent: Aug. 5, 2014

(54) ELECTRONIC TORQUE WRENCH WITH REPLACEABLE TORQUE SENSORS

(75) Inventor: Angelo Chiapuzzi, Milan (IT)

(73) Assignee: Atlas Copco BLM S.R.L., Paderno Dugnano, Milan (IT)

( * ) Notice: Subject to any disclaimer, the term of this patent is extended or adjusted under 35 U.S.C. 154(b) by 981 days.

(21) Appl. No.: 12/736,123

(22) PCT Filed: Mar. 12, 2009

(86) PCT No.: PCT/IB2009/000527

§ 371 (c)(1),
(2), (4) Date: Nov. 19, 2010

(87) PCT Pub. No.: WO2009/115889

PCT Pub. Date: Sep. 24, 2009

(65) Prior Publication Data

US 2011/0100170 A1 May 5, 2011

(30) Foreign Application Priority Data

Mar. 18, 2008 (IT) ..... MI2008A00462

(51) Int. Cl.
*B25B 23/142* (2006.01)

(52) U.S. Cl.
USPC ..... 81/479; 73/862.21

(58) Field of Classification Search
USPC ..... 81/463–483; 73/862–862.24; 16/110.1–114.1, 405–407
See application file for complete search history.

(56) References Cited

U.S. PATENT DOCUMENTS

| | | | | |
|---|---|---|---|---|
| 6,234,051 | B1 * | 5/2001 | Bareggi | 81/479 |
| 6,948,380 | B1 * | 9/2005 | Shiao et al. | 73/862.21 |
| 2007/0119267 | A1 * | 5/2007 | Anjanappa et al. | 73/862.21 |

FOREIGN PATENT DOCUMENTS

| | | | | |
|---|---|---|---|---|
| DE | 42 43 317 | A1 | 6/1993 | |
| DE | 20 N2004 017472 | U1 | 1/2005 | |
| DE | 202004017472 | * | 1/2005 | B25B 23/142 |
| DE | 10 2005 039682 | A1 | 3/2006 | |
| EP | 1 060 84 | A | 12/2000 | |
| WO | WO 00/45997 | A | 8/2000 | |

OTHER PUBLICATIONS

PCT Search Report dated Jul. 10, 2009.

* cited by examiner

*Primary Examiner* — Lee D Wilson
*Assistant Examiner* — Melanie Alexander
(74) *Attorney, Agent, or Firm* — Hedman & Costigan, P.C.; James V. Costigan; Kathleen A. Costigan

(57) ABSTRACT

An electronic torque wrench (10) comprising a grip body (11) with a user interface (12) and a control electronics (13) for controlling the wrench. From one extremity of the grip body protrudes a mechanical connection element (14) that terminates at one extremity with a tightening head (16). In the connection element are torque sensors (18) for determining the torque transmitted between the grip body and the head and the connection element (14) is connected in a removable and replaceable way to the grip body (11) and comprises memory means (19) containing data for calibrating the wrench to such connection element (14) and means for transferring such data to the control electronics.

12 Claims, 1 Drawing Sheet

ELECTRONIC TORQUE WRENCH WITH REPLACEABLE TORQUE SENSORS

The present invention refers to an electronic torque wrench of the type comprising a grip body from which protrudes an extremity terminating with a tightening head.

Generally speaking, such types of wrench are made like a bending-bar transducer having extensometers for measuring the deformation proportionate to the transmitted torque. The extremity of the bar opposite the grip is designed for fitting tools of various shapes suitable for transmitting the torque to screws, bolts, tightening elements, etc. The wrench comprises a user interface with a display unit on which the tightening quantities are shown calculated by internal electronics on the basis of the readings of the torque sensors and of other sensors, e.g., angle sensors.

The transducer is usually conveniently housed in a tubular element, which supports it and at the same time protects the extensometers. Such tubular element is connected integral with the grip body and is an integral part of it, forming a single indissoluble unit envisaged for a determinate measurement range.

In fact, apart from the ergonomic need to differentiate the models according to the maximum wrench torque, to ensure a level of accuracy of the measurements, several models are normally needed, each with a measurement range of its own, which does not generally exceed a 1:5 ratio. For example, a wrench with maximum nominal torque of 250 Nm can operate with sufficient accuracy starting with 50 Nm, a wrench of 100 Nm can start from 20 Nm, and so on.

It follows that to cover an albeit limited range of tightening torques, it could be necessary to have a certain number of torque wrenches, sometimes with a large investment.

Furthermore, in the case of repair or replacement of the torque transducer unit, this operation must necessarily be performed by the manufacturer or by an authorized repair centre and, in any case, the subsequent calibration of the wrench must be done in an adequately equipped metrological laboratory, with time losses sometimes not reconcilable with the user's needs.

The general object of the present invention is to overcome the above-mentioned drawbacks and provide an electronic torque wrench that permits fast adaptability to a broad range of measurement ranges. Furthermore, a further object is to facilitate the repair and cut the tool down times in case of a torque sensor fault.

In view of such object, the idea occurred to make, according to the invention, an electronic torque wrench comprising a grip body having a user interface and a wrench control electronics, from an extremity of the grip body protruding a mechanical connection element terminating at one end with a tightening head, in the connection element being present torque sensors for determining the torque transmitted between the grip body and the head, characterized in that the connection element is connected in a removable and replaceable way to the grip body and comprises memory means containing data for calibrating the wrench with said connection element and means for the transfer of such data to the control electronics.

To more clearly explain the innovative principles of the present invention and its advantages with respect to prior art, a description will be provided below, with the aid of the attached drawings, of a possible exemplary embodiment applying such principles. In the drawings.

Figure 1:
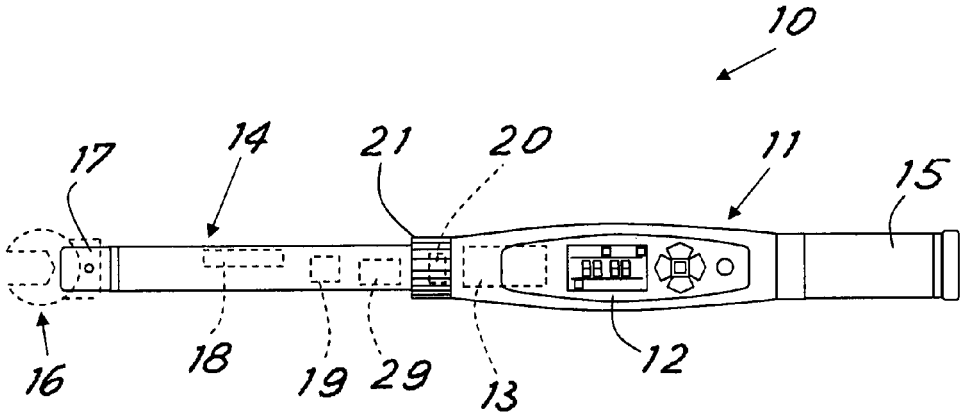
FIG. 1 represents a schematic view of a torque wrench according to the invention.

With reference to the illustrations, the FIG. 1 shows an electronic torque wrench generically indicated by 10. The wrench comprises a grip body 11 with a user interface 12 and a control electronics of the wrench 13. In the body can also be housed electric power batteries (not shown).

The control electronics is of the type known to prior art (e.g., with suitably programmed microprocessor) and will not be further described or shown here. As the expert technician can easily imagine, it will show, for example, on a suitable display of the user interface, various parameters and tightening measurements, according to what is detected by the wrench sensors and operating settings entered by means of commands given by means of the user interface present on the body 11 and/or by means of the remote commands received and transmitted by means of any wireless or wired connection systems.

An element 14 protrudes from an extremity of the grip body which is opposite the extremity 15. The element 14 terminates at an extremity with a tightening head 16 so as to make a mechanical connection between the body 11 and the tightening head 16. The tightening head 16 can be made removable and replaceable on the connection element, by means of a suitable coupling 17 of the type known to prior art (e.g., a standard square coupling). Advantageously, the connection element is made in the form of a straight tubular element.

In the connection element 14 are present known torque sensors 18 (e.g., extensometer sensors) for detecting the torque transmitted between the grip body 11 and the head 16. The connection element is connected in a removable and replaceable way to the grip body and comprises memory means 19 containing calibrating data of the wrench with such connection element 14. Also provided are means 20 for the transfer of such data to the control electronics of the wrench together with the readings of the torque sensors. Advantageously, the memory means comprise an $E^2$prom memory which can be programmed with the calibration data read during a connection element calibration test. If a subsequent re-calibration is necessary, the operation is thereby made easier by the use of a re-programmable memory.

Also advantageously present in the element 14 can be a known angular rotation sensor 29, calibrated together with the torque sensor and this too connected to the control electronics to make known measurements that also require information relating to wrench angular rotation. The memory 19 will also contain the calibration data of this angular sensor paired with the torque sensor.

A quick coupling 21 is envisaged between connection element and body 11 to allow the rapid replacement of the connection element.

Figure 2:
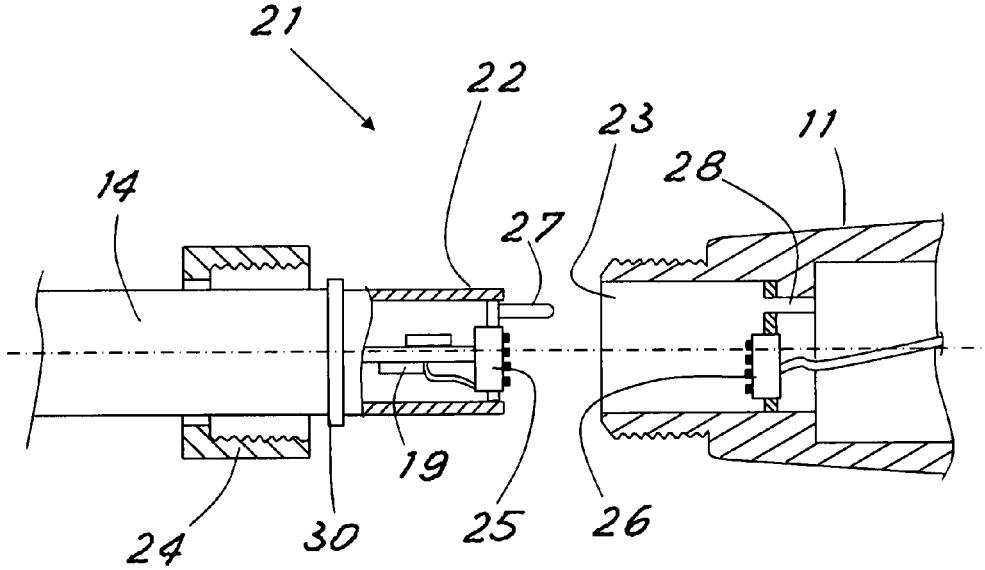
FIG. 2 represents a schematic view, partial and in section of an area of the wrench of FIG. 1 disassembled.

According to a preferred embodiment of the quick coupling, shown in disassembled condition in FIG. 2, the connection element is equipped with an axial coupling 22 in a complementary seat 23 on the grip body 11. The axial coupling advantageously comprises ring-nut means 24 for screw or bayonet locking.

In the axial coupling case shown, also advantageously present is a locator 27 of reference of the angular position between grip body and connection element. Advantageously, such locator consists of a pin 27 protruding parallel to the coupling axis of the element 14 which fits into a specific seat 28 in the body 11 (or vice versa).

Advantageously, the axial coupling also comprises inside electric contacts 25, 26 for connecting the sensors 18 and some memory means 19 to the control electronics in the grip body. The contacts are preferably of the front coupling type, so the axial coupling of the mechanical connection element 14 on the grip body also automatically makes the power connection.

The assembly only calls for the introduction of the section 22 (e.g., cylindrical or precision) in the seat 23 and the tightening of the ring nut 24 on the specific extremity of the wrench body. Thanks to the presence on the pipe of a stop collar 30 which interacts on the bottom of the ring nut 24, the solid mechanical union is obtained of the connection element 14, that forms the transducer unit, with the wrench body and a contemporaneous multi-contact electrical connection between the two parts.

As the technician can easily imagine on the basis of the description given here, connection means can also be used without electric contact, e.g., by means of transponder.

In the event of heads 16 being used with inserts having known electronic systems of identification by the wrench, the corresponding identification signals can also be transferred from element 14 to the wrench.

If so desired, other sensors can be fitted in the connection element and the memory means can include suitable calibration data for such sensors as well. If necessary, angle sensors can also be fitted in the grip.

In any case, the calibration operation can be performed a priori by the manufacturer in the same physical and geometric conditions they are in when the mechanical connection element 14 is fitted on the grip body having its own electronics.

This way, the electronics of the wrench body receives (e.g., at start-up) the required information and the operating parameters for the immediate use of the fitted transducer unit, without any further calibrations having to be made.

At this point, it is clear how the preset objects have been achieved.

Thanks to the principles of the invention, the wrench can be fitted with a plurality of interchangeable connection elements 14 (only one of which is shown for the sake of simplicity in the illustrations), each with different length and/or measurement sensors suitable for a different torque interval or for different types of measurement. The calibration data of each element are already contained in the internal memory means of the element, so that all the operator has to do is disengage a connection element and replace it with another selected one to obtain a wrench suitable for a new tightening torque interval.

Even in the case of a fault affecting the torque sensors, all the operator has to do is replace the connection element with another, already pre-calibrated, without any need for a tool stop for the calibration. The operator must also keep, easily and at limited cost, spare connection elements 14, so as to be able to quickly overcome any malfunction of the sensors.

The operator will not need to perform calibrations on the torque transducer, an operation that generally requires adequate equipment and specific know-how. Even in the case of the presence of a gyroscope, with the prior art wrenches a generally complicated calibration operation would be needed, but with the wrench described here such operation is no longer necessary.

Because the tubular element that contains the transducer and other measurement systems can be calibrated separately, it follows that the wrenches can be assembled definitively according to the requirement: consequently the stock of finished wrenches in store can be considerably reduced because the two units can be kept separate and only assembled at the time of dispatch. If necessary, the wrench could be sent disassembled and then assembled by the user before use.

Naturally, the above description of an embodiment applying the innovative principles of the present invention is shown by way of example of such innovative principles only and should not therefore be taken as limitative of the patent right ambit claimed here.

The invention claimed is:

1. Electronic torque wrench (10) comprising a grip body (11) having a user interface (12) and a control electronics (13) for controlling the wrench, wherein a mechanical connection element (14) protrudes from one extremity of the grip body (11), with said mechanical connection element (14) terminating at its extremity opposite said one extremity of the grip body, with a tightening head (16), in the connection element (14) being present torque sensors (18) for determining the torque transmitted between the grip body and the head, characterized in that the connection element (14) is connected in a removable and replaceable way to the grip body (11) and comprises memory means (19) that contain data for calibrating the wrench to such connection element (14) and means for transferring such data to the control electronics.

2. Wrench according to claim 1, characterized in that for the removable and replaceable connection, between the connection element and the grip body (11) an axial coupling (21) is present.

3. Wrench according to claim 2, characterized in that the axial coupling has ring nut means (24) for screw or bayonet locking.

4. Wrench according to claim 2, characterized in that the axial coupling (21) comprises electric contacts (25, 26) for connecting the sensors and the memory means to the control electronics in the grip body.

5. Wrench according to claim 2, characterized in that the axial coupling comprises a locator (27, 28) of reference of the angular position between grip body and connection element.

6. Wrench according to claim 1, characterized in that the tightening head (16) can be coupled in a removable and replaceable way on the connection element (14).

7. Wrench according to claim 1, characterized in that the connection element (14) is made in the shape of a straight tubular element.

8. Wrench according to claim 1, characterized in that in the connection element (14) an angular rotation sensor (29) is also present.

9. Wrench according to claim 1, characterized in that the memory means (19) comprise an $E^2$prom memory.

10. Wrench according to claim 1, characterized in that it comprises a plurality of interchangeable connection elements (14), each of different length.

11. Wrench according to claim 1, characterized in that it comprises a plurality of interchangeable connection elements (14), each of different length and different measurement sensors suitable for a different torque interval.

12. Wrench according to claim 1, characterized in that it comprises a plurality of interchangeable connection elements (14), each of different length and having different sensors.

* * * * *